US005993577A

United States Patent [19]

Erickson et al.

[11] Patent Number: 5,993,577

[45] Date of Patent: Nov. 30, 1999

[54] LEAD-FREE, HEAVY-METAL-FREE RIM-FIRE PRIMING COMPOSITION DEDICATED FOR RALPH B. LYNN

[75] Inventors: Jack A. Erickson; John M. Melberg, both of Andover; Joel L. Sandstrom, Corcoran, all of Minn.

[73] Assignee: Federal Cartridge Company, Anoka, Minn.

[21] Appl. No.: 09/148,192

[22] Filed: Sep. 4, 1998

[51] Int. Cl.[6] ..... C06B 31/28; C06B 47/08; C06B 25/04

[52] U.S. Cl. ..... 149/68; 149/36; 149/105

[58] Field of Search ..... 149/23, 39, 68, 149/45, 105

[56] References Cited

U.S. PATENT DOCUMENTS

| | | | |
|---|---|---|---|
| 2,009,556 | 7/1935 | McNutt . | |
| 2,027,825 | 6/1936 | Jacobs . | |
| 2,157,669 | 5/1939 | Lazier . | |
| 2,415,806 | 2/1947 | Bain . | |
| 4,608,102 | 8/1986 | Krampen et al. | 149/92 |
| 4,674,409 | 6/1987 | Lopata . | |
| 4,675,059 | 6/1987 | Mei . | |
| 4,689,185 | 8/1987 | Lopata . | |
| 5,216,199 | 6/1993 | Bjerke . | |
| 5,353,707 | 10/1994 | Duguet | 102/290 |
| 5,466,315 | 11/1995 | Erickson et al. | 149/96 |
| 5,538,569 | 7/1996 | Carter | 149/105 |
| 5,610,367 | 3/1997 | Erickson . | |
| 5,684,268 | 11/1997 | Lopata | 149/39 |
| 5,831,208 | 11/1998 | Erickson | 149/18 |

FOREIGN PATENT DOCUMENTS

| | | |
|---|---|---|
| 580486 | of 0000 | European Pat. Off. . |
| 704415 | 3/1996 | European Pat. Off. . |

*Primary Examiner*—Michael J. Carone
*Assistant Examiner*—Aileen J. Baker
*Attorney, Agent, or Firm*—Schroeder & Siegfried PA

[57] ABSTRACT

A lead-free, heavy-metal free rim-fire priming composition consisting essentially of diazodinitrophenol (DDNP) as a primary explosive, a low percentage of a secondary sensitization explosive (tetracene), with a high percentage of abrasive (ground glass) and a very low percentage of an effective lead-free, heavy-metal-free oxidizer. A strong binder is added to aid in the installation and retention of the composition within the rim of the casings. A dye is also included for the sole purpose of facilitating visual inspection within the casing after installation of the composition within the rim. The high percentage by weight of the ground glass (46–60%) in combination with DDNP is of principal importance. The preferred mix is comprised of 29.8% of DDNP, 4.0 tetracene, 57.0% ground glass, and 7.5% potassium nitrate with 1.5% gum tragacanth added as a binder and 0.2% Prussian Blue as a dye.

25 Claims, 1 Drawing Sheet

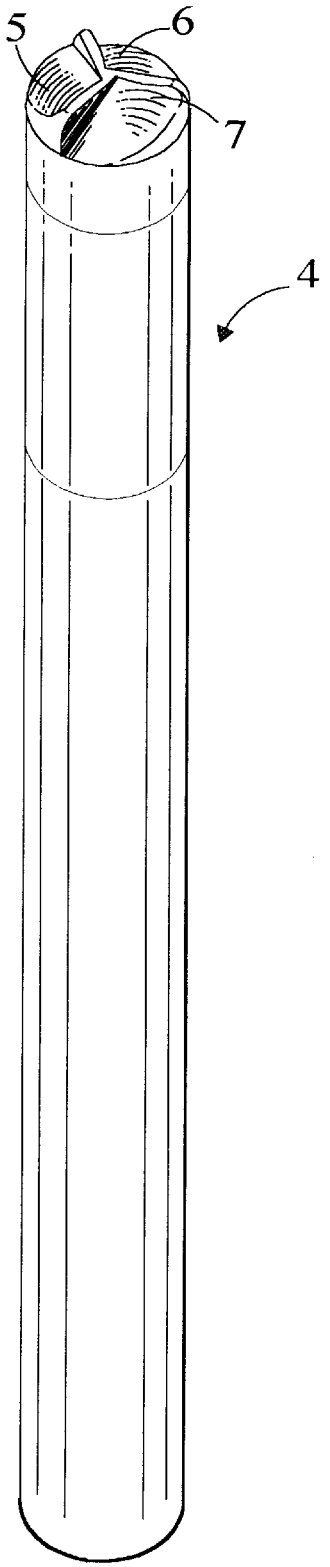
Fig. 1
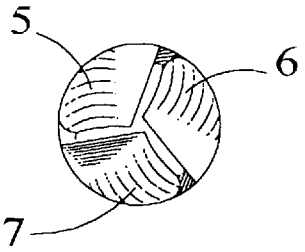
Fig. 2
Fig. 3
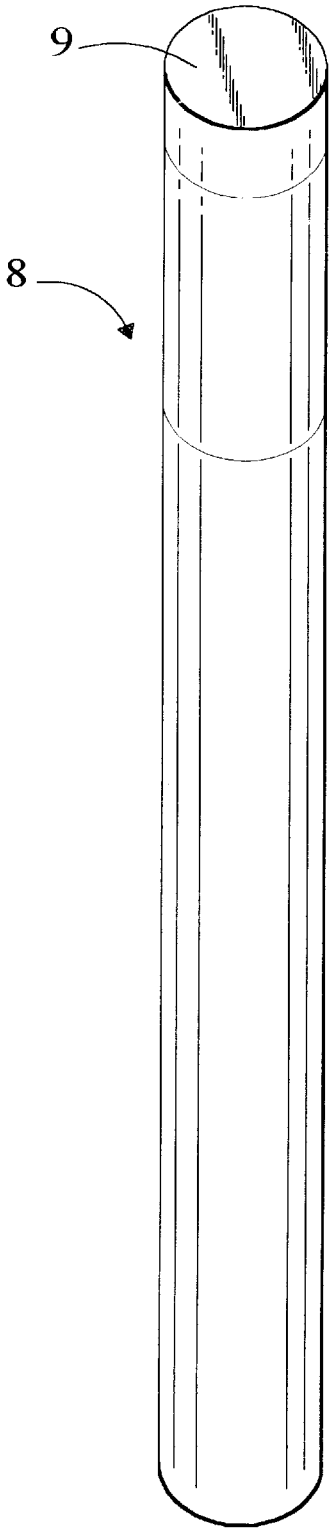

LEAD-FREE, HEAVY-METAL-FREE RIM-FIRE PRIMING COMPOSITION DEDICATED FOR RALPH B. LYNN

DESCRIPTION

Background of the Inventioon

The present invention relates to a new primer mix for rim-fire cartridges which is both lead-free and heavy-metal-free, and yet functions at least equally effectively.

Despite the fact that many attempts have been made and many patents have been obtained on various primer compositions, it appears that the only commercially feasible non-corrosive primer composition heretofore developed for rim-fire cartridges has been the combination of lead styphnate and tetracene as the primary explosive. This is true despite the fact that the by-products of firing such a composition include lead, which is considered toxic and, hence, such compositions are widely recognized as undesirable.

One of the substitutes for lead styphnate which has been widely tried is diazodinitrophenol (DDNP) because it is non-toxic and fairly sensitive. It is somewhat lacking in sensitivity, however, as is evidenced by the fact that a number of U.S. patents have issued for rim-fire compositions, based upon the use of DDNP, but no rim-fire cartridges utilizing same can be found in the market.

Thus, U.S. Pat. Nos. 2,009,556; 4,674,409; 4,689,185; 4,675,059; and 5,216,199 each use DDNP in different combinations in an effort to take advantage of its non-toxicity. The lack of adequate sensitivity, however, has not been overcome by any practical means.

It has been suggested that perhaps DDNP is not sufficiently dense and that its density can be increased by compacting the composition within the rim and thereafter covering same with a separate layer, or by compacting the propellant over the primer composition, so as to cause the latter to be retained within the rim when it is struck by a firing pin. Such procedures, however, have proved to be difficult and expensive. In fact no one has heretofore conceived of a practical way to raise the sensitivity of DDNP to an adequate level for rim-fire use.

KDNBF has also been proposed as a primary explosive, as in EPO 580286 A1 and EPO 704415A1, but it has been found to have insufficient sensitivity for rim-fire priming compositions and is difficult to manufacture.

In short, no practical alternative to the use of toxic lead styphnate and tetracene has heretofore been suggested for use as the primary explosive in a rim-fire primer composition. The primer compositions used in center-fire cartridges are insufficiently sensitive and those suggested as rim-fire compositions, as indicated above, are either toxic or impractical. Thus, it is clear that there remains a definite need for a practical lead-free, heavy-metal-free rim-fire primer composition.

BRIEF SUMMARY OF THE INVENTION

We have discovered a highly effective and practical primer mix for rim-fire cartridges which is both lead-free and heavy-metal free, and utilizes the substantial attributes of diazodinitrophenol (DDNP). The heavy metals about which concern is most frequently expressed are lead, mercury, barium and antimony.

In our research for a more suitable primer mix, we decided that we would need a dense rigid pellet with a highly abrasive content while using a primary explosive that can be readily manufactured, economically and safely. We chose DDNP as the primary explosive, tetracene as the sensitizer, glass as the frictionator, potassium nitrate as an oxidizer and gum tragacanth or gum arabic as a binder.

We have discovered that if an unusually high percentage of ground glass is mixed with certain specified percentages of DDNP and tetracene, and an unusually low percentage of an oxidizer such as potassium nitrate and an unusually high percentage of gum tragacanth, good results are obtained. Pressure and velocity measurements indicate that this priming composition compares favorably with regular lead styphnate ammunition.

We believe that the high percentage of ground glass effectively enhances the sensitivity of the DDNP, and the unusual amount of tragacanth acts to hold the composition within the rim of the casing when the latter is struck with a firing pin, to thereby insure that it explodes properly. Our tests show, however, that the high percentage of ground glass is essential. We have found that the performance of our new primer mix enables us to utilize "hard" casings, which allows the ammunition to function well in semiautomatic rifles and pistols.

We believe that at least part of the difficulties experienced in the attempts to utilize the primer mixes disclosed in the various patents referred to hereinbefore, or known otherwise, is that the primer composition may have flaked off, but did not ignite the primer charge within the annular rim cavity, when the firing pin hit the rim of the casing. We believe that the filling of the rim cavity and the retention of the primer therein by the much greater amount of gum is enhanced by the double bit treatment (to be discussed hereinafter) which we use to inject the primer mix into the annular recess of the rim of the casing.

Our preferred percentages of the dry weight components of our new primer mix are shown below:

| Component | Preferred % | Preferred Range % | Broad Range % |
|---|---|---|---|
| DDNP (explosive) | 29.8 | 28–32 | 25–35 |
| Tetracene (sensitizer) | 4.0 | 3.0–5.0 | 2.0–5.0 |
| Potassium Nitrate (oxidizer) | 7.5 | 6.0–9.0 | 5–14 |
| Glass (abrasive) | 57 | 55.0–60.0 | 46–60 |
| Gum Tragacanth (binder) | 1.5 | 1.2–1.6 | 0.75–2.0 |
| Prussian Blue or Manox Blue (dye) | 0.2 | 0.1–0.2 | 0.1–0.2 |

From the above, it can be seen that our new mix includes an unusually high percentage of ground glass with an unusually high percentage of tragacanth gum, and an unusually low percentage of oxidizer. The former elevates the sensitivity of the DDNP while the gum sets the composition within the annular cavity of the rim of the casing and holds it there while the rim is struck by a firing pin.

The results of the tests which we have run on our new primer composition show that our new mix compares favorably against the results of tests of rim fire cartridges containing lead styphnate, which are currently on the market. We have found that our new mix functions well, even as compared to lead styphnate mixes, both as to pressure and velocity, when used in either "soft" or "hard" casings.

BRIEF DESCRIPTION OF THE DRAWINGS

FIG. 1 is a perspective view of a fluted spinning bit which is utilized in charging the rims of the rim-fire casings with our new primer composition;

FIG. 2 is a bottom elevational view of the fluted bit shown in FIG. 1; and FIG. 3 is a perspective view of a "flat" spinning bit which is utilized to complete the charging operation of the rim-fire casings having a hardness of 130 DHP or greater, after utilizing a fluted bit to fling the major portion of the pellet of priming composition outwardly into the rim cavity.

DETAILED DESCRIPTION OF THE INVENTION

As indicated above, we have run a substantial number (101) of tests in developing and checking the performance of various samples made up in accordance with our preconceived conclusion that we needed to utilize an unusually high percentage of ground glass in combination with DDNP, with an unusually high percentage of gum and a substantially reduced percentage of an oxidizer to develop an improved priming composition which is both lead-free and heavy-metal-free.

On our 61st sample, we developed a mixture which gave acceptable sensitivity, flame temperature, brisance and chargability to be considered robust enough for a commercial rim-fire priming. We found that this sample could be successfully used in brass rim-fire casing having a metal hardness of up to about 160 DPH. We found that the results compared favorably with those experienced in the use of lead styphnate primer compositions currently found on the market. Since we found that this priming composition could be used in brass rim-fire cases having a metal hardness of 160 DPH, we recognized that this priming composition is of substantial value and improvement, since casings having such a hardness will function well in semi-automatic rifles and pistols, whereas casings having a lower hardness, such as less than 130 DPH, do not function in such arms in a satisfactory manner.

The following is an example of a sample which we have found to be highly effective as a rim-fire priming composition:

16.95 grams of DDNP containing 30% $H_2O$ and 2.13 grams of tetracene containing 25% $H_2O$ are, placed in a mixing container and thoroughly blended.

0.6 grams of Gum Tragacanth 0.08 grams of Manox Blue dye 3.0 grams of $KNO_3$ (pulverized)

22.8 grams of ground glass are weighed into a container and blended to produce the dry blend material. The ground glass particles have a particle size of 0.004"–0.006." A typical Sieve analysis specification gives the following results:

| | | |
|---|---|---|
| U.S. Sieve No. 60 | Max | 0.1% held |
| U.S. Sieve No. 80 | | 1.2% held |
| U.S. Sieve No. 100 | | 30.8% held |
| U.S. Sieve No. 200 | | 65.4% held |
| | | 2.6% passes |

The container of dry blend was then added to the DDNP-tetracene. The two components are very thoroughly mixed and water is added, as needed, to produce a paste-like texture which can be charged into primer pellets of 21–30 mg.

After completing the mixture of the dry blend with the DDNP-tetracene, as indicated above, the composition is inserted into the openings of a charge plate in the conventional manner. Thereafter the primer pellets are "knocked out" of the charge plate into the rim-fire casings in the conventional manner. The pellets are then spun with a "fluted" spinner bit if "soft" <130 DPH casings are to be utilized. If "hard" 130 DPH or above (160 DPH preferred) casings are to be used, such a fluted bit is first used to move the mix around and into the rim of the case. Thereafter, a second spinning with a "flat" spinning bit is utilized to further move the mix into the rims of the casings. This second spinning with a "flat" spinning bit improves the sensitivity of the primed case. The wet primed cases are then dried at about 150 degrees F. and thereafter are cooled, at which point they are then ready to be loaded, in the typical fashion, with propellant and bullet.

FIGS. 1–3 inclusive show the structure of the spinning bits referred to above. FIGS. 1–2 show the fluted bit consisting of a cylindrical rod 4, the lower end of which is constructed to form three (3) separate flutes, 5–7, inclusive, which function to throw the primer composition of the pellet outwardly into the cavity of the rim of the casings. The bits, of course, are spun about their longitudinal axis.

FIG. 3 shows the "flat" spinning bit, consisting of a section of a cylindrical rod, 8, the lower end 9 of which is flat, in that the rod is cut thereat at a right angle to its longitudinal axis, leaving the lower end flat. Each of the bits in FIGS. 1–3 has a diameter only slightly smaller than the internal diameter of the casings to be filled. If desired, the peripheral portions of the lower end of the "flat" spinning bit may be slightly beveled to facilitate insertion of the lower end of the bit, and the guiding thereof, into contact with the bottom the of casings.

The above primed casings have been thereafter tested for sensitivity with the conventional testing equipment which utilizes a two ounce ball. SAAMI requires H+4, less than 16.5 inches with such a two ounce ball. These tests provided the following results:

| Sample # | Gum Content | Cases Used | H | S | H + 4 | H − 2 | All F Res | All M iss |
|---|---|---|---|---|---|---|---|---|
| LF-93 | 1.5% Gum T | UM .039 rims Lach. Soft | 5.66 | 1.93 | 13.38 | 1.8 | 13 | 3 |
| LF-95 | .75% T .75% A | UM .041 Lach. Soft | 7.58 | 1.46 | 13.44 | 4.66 | 11 | 5 |
| LF-93 | 1.5% Gum T | .041 Lach. Hard 2 Spin | 6.38 | 1.14 | 10.94 | 4.1 | 10 | 5 |
| LF-93 | 1.5% Gum T | UM .041 Lach. Hard 1 Spin | 7.78 | 1.68 | 14.52 | 4.42 | 12 | 4 |
| LF-92 | 1.0%T 0.5% A | UM .041 Lach. Soft 1 Spin | 6.42 | 1.44 | 12.18 | 3.54 | 10 | 4 |
| LF-92 | 1.0% T | UM .041 Lach. | 6.46 | 1.21 | 11.32 | 4.04 | 9 | 4 |

-continued

| Sample # | Gum Content | Cases Used | H | S | H + 4 | H − 2 | All F Res | All M iss |
|---|---|---|---|---|---|---|---|---|
| | 0.5% A | Hard 1 Spin | | | | | | |
| LF-82 | 1.5% Gum T | UM .041 Lach. Hard 1 Spin | 6.26 | 0.95 | 10.06 | 4.36 | 9 | 4 |
| LF-82 | 1.5% Gum T | UM .041 Lach. Soft 1 Spin | 5.42 | 1.32 | 10.72 | 2.78 | 9 | 2 |
| LF-91 | 1.0% T 0.5% A | .041 Lach. Soft 2 Spin | 5.82 | 1.08 | 10.14 | 3.66 | 8 | 4 |
| LF-87 | 1.5% Gum T | UM .041 Lach. Soft 1 Spin | 6.54 | 1.63 | 13.08 | 3.28 | 10 | 3 |
| LF-87 | 1.5% Gum T | .041 Lach. Soft 2 Spin | 6.02 | 0.98 | 9.95 | 4.06 | 8 | 3 |
| LF-86 | 1.5% Gum T | UM .041 Conv. Soft 1 Spin | 5.26 | 1.3 | 10.46 | 2.66 | 9 | 3 |
| LF-81 | 1.5% Gum T | Req. Lach 2 Spin | 6.5 | 1.38 | 12.04 | 3.74 | 9 | 3 |
| LF-80 | 0.5% T 8.05% $KNO_3$ | Req. Lach 2 Spin | 6.74 | 1.63 | 13.27 | 3.48 | 11 | 3 |
| LF-79 | .75% T B.05% | Req. Lach 2 Spin | 6.62 | 1.14 | 11.19 | 4.34 | 10 | 4 |
| LF-78 | .75% T 75% A | Req. Lach 2 Spin | 6.58 | 1.76 | 13.62 | 3.06 | 13 | 3 |
| LF-93 | | UM Conv. Soft 1 Spin | 5.5 | 1.3 | 10.68 | 2.9 | 9 | 2 |
| LF-96 | | UM Conv. Soft 1 Spin | 7.1 | 1.81 | 14.34 | 3.48 | 11 | 3 |
| LF-99 | | Lach. - Soft 2 Pellet 2 Spin | 6.98 | 1.36 | 12.42 | 4.26 | 11 | 4 |
| LF-99 | | Lach. - Hard 2 Pellet 2 Spin | 6.62 | 1.24 | 11.58 | 4.14 | 9 | 3 |
| LF-100 | | Lach. - Hard 2 Pellet 2 Spin | 6.66 | 0.68 | 9.37 | 5.3 | 9 | 5 |

The example indicated above provides the ranges and preferred values of our new, improved priming composition as set forth hereinabove in our Summary of the Invention.

Typically, the mix is charged into casings utilizing a 21–30 mg. pellet which approximately fills the cavity of the 0.22 caliber casing. Typically, the composition is spun into the rim of the rim-fire casings with a fluted bit. In the situation where it is desired to utilize more hardened brass casings, the priming composition is first moved toward and into the rim cavity with the fluted bit and thereafter, is further moved and compacted therein with the "flat" spinning bit, as desired for sensitivity. This priming is unique in that when so spun into the casing, it provides adequate sensitivity and ignition in metal casings having a hardness of about 160 DPH.

Pressure and velocity measurements have been made on the above priming compositions to compare them with that obtained on regular lead styphnate ammunition found on the market. These pressure and velocity measurements indicate that this priming compares favorably with such regular lead styphnate ammunition. Listed below are the typical results received in making such pressure and velocity measurements:

40 gr. bullet utilizing propellant OBP372 on Jul. 9, 1998

| | Velocity | Pressure |
|---|---|---|
| Sample priming batch LF-87 (Ave. of 10) | 1239 | 23118 |
| Control priming (Lead Styphnate) (Ave. of 10) | 1250 | 20258 |
| 37 gr. bullet utilizing propellant OBP372 | | |
| Sample priming batch LF-74 (Ave. of 10) | 1248 | 21115 |
| Control priming (Lead Styphnate) | 1263 | 20111 |

-continued (Ave. of 10)

The priming mix described above has the following percentage of chemical components:

| | Preferred % | Acceptable Range |
|---|---|---|
| DDNP | 29.8 | 25–35 |
| Tetracene | 4.0 | 2–5 |
| Pulverized $KNO_3$ | 7.5 | 5–14 |
| Ground Glass | 57.0 | 49–60 |
| Gum Tragacanth | 1.5 | 0.75–2.0 |
| Prussian or Manox Blue Dye | 0.2 | 0.1–0.2 |

Most, if not all, rim-fire manufacturers of today use lead styphnate with tetracene as the primary explosive in their rim-fire compositions. The above test results show that we have provided a new lead-free and heavy-metal-free rim-fire priming composition which functions equally well or better than the lead styphnate priming compositions currently being utilized on the market. An added benefit obtained is the environmental effect of our invention, in that it obviates the introduction of substantial amounts of lead into the air. As shown, it contains a primary explosive and a secondary sensitization explosive with a high percentage of abrasive and very low percentage of oxidizer and a strong binder that can be used both in soft casings and in hard brass casings. In the former instance, we spin the composition into the rim cavity once with a fluted bit such as bit 4, whereas when hard casings are being utilized, we spin the composition into the rim cavity with both a fluted and a flat spinning bit such as bit 8. In either case, however, the composition utilized is the same. When the flat bit 8 is utilized, it forces substantially all of the priming composition into the rim of the casings and compacts the same therein, whereas the fluted bit 4, when used, only flings the primary composition into the rim cavity and hence does not provide the compaction and increased density which is furnished by the "flat" spinning bit. We believe the compaction provided by the "flat" spinning bit is instrumental in providing the necessary sensitivity to the primer composition within the "hard" casings, having a DPH of 130 or more.

It will, of course, be understood that various changes may be made in the form, details, arrangement and proportions of the parts without departing from the scope of the invention which comprises the matter shown and described herein and set forth in the appended claims.

We claim:

1. A substantially lead-free, heavy-metal-free rim-fire primer composition with DDNP, the active ingredients of which comprise a mixture of:

(a) 25–35% by weight of DDNP;

(b) 2.0–5.0% by weight of tetracene;

(c) 46–60% by weight of ground glass; and (d) 5–14% by weight of a lead-free, heavy-metal free oxidizer.

2. The primer composition defined in claim 1, wherein the percentage by weight of DDNP is about 30%.

3. The primer composition defined in claim 1, wherein the percentage by weight of tetracene is about 4.0%.

4. The primer composition defined in claim 1, wherein the percentage by weight of ground glass is about 57%.

5. The primer composition defined in claim 1, wherein the oxidizer is potassium nitrate.

6. The primer composition defined in claim 1, wherein said composition includes about 0.75–2.0% by weight of gum tragacanth.

7. The primer composition defined in claim 1, wherein said composition includes about 0.1–0.2% of Prussian Blue dye.

8. The primer composition defined in claim 1, wherein said primer composition includes about 7.5% by weight of potassium nitrate as the oxidizer.

9. The primer composition defined in claim 1, wherein the percentage by weight of DDNP is about 28–32%.

10. The primer composition defined in claim 1, wherein the percentage by weight of tetracene is about 3.0–5.0%.

11. The primer composition defined in claim 1, wherein the oxidizer is potassium nitrate and the percentage by weight thereof is about 6.0–9.0%.

12. The primer composition defined in claim 1, wherein the percentage by weight of ground glass is about 55.0–60.0%.

13. The primer composition defined in claim 1, wherein the percentage by weight of DDNP is about 28.0–32.0% and the percentage by weight of ground glass is about 55.0–60.0%.

14. A substantially lead-free, heavy-metal-free rim-fire primer composition with DDNP, consisting essentially of:

(a) 25–35% by weight of diazodinitrophenol (DDNP);

(b) 2.0–5.0% by weight of tetracene;

(c) 46–60% by weight of ground glass;

(d) 5–14% by weight of an oxidizer; and (e) 0.75–2.0% by weight of a gum.

15. The rim-fire primer composition defined in claim 14, wherein the percentage by weight of diazodinitrophenol (DDNP) is about 28.0–32.0%.

16. The rim-fire primer composition in claim 14 wherein the percentage by weight of diazodinitrophenol (DDNP) is about 30%.

17. The rim-fire primer composition in claim 14, wherein the percentage by weight of tetracene is about 3.0–5.0%.

18. The rim-fire primer composition in claim 14, wherein the percentage by weight of tetracene is about 4%.

19. The rim-fire primer composition in claim 14, wherein the percentage by weight of ground glass is about 55–60%.

20. The rim-fire primer composition in claim 14, wherein the percentage by weight of ground glass is about 57%.

21. The rim-fire primer composition defined in claim 14, wherein the oxidizer is potassium nitrate.

22. The rim-fire primer composition defined in claim 14, wherein the oxidizer is potassium nitrate and the percentage by weight thereof is about 7.5%.

23. The rim-fire primer composition defined in claim 14, wherein the gum content thereof is about 1.5%, by weight.

24. The rim-fire primer composition defined in claim 14, wherein an additional component thereof is Persian Blue dye in an amount of about 0.1–0.2%, by weight.

25. A substantially lead-free, heavy-metal-free rim-fire primer composition with DDNP, consisting essentially of:

(a) 25–35% by weight of DDNP;

(b) 2.0–5.0% by weight of tetracene;

(c) 46–60% by weight of ground glass;

(d) 5–14% by weight of potassium nitrate; and (e) 0.75–2.0% by weight of gum tragacanth.

* * * * *